US011236626B2

(12) United States Patent
Sato et al.

(10) Patent No.: US 11,236,626 B2
(45) Date of Patent: Feb. 1, 2022

(54) STATOR BLADE SEGMENT AND STEAM TURBINE

(71) Applicant: Mitsubishi Power, Ltd., Yokohama (JP)

(72) Inventors: Hideaki Sato, Yokohama (JP); Shouhei Danno, Yokohama (JP); Kimihiro Todo, Yokohama (JP); Tomohiro Horai, Yokohama (JP); Tatsuo Nakamoto, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 0 days.

(21) Appl. No.: 16/973,191

(22) PCT Filed: Jun. 3, 2019

(86) PCT No.: PCT/JP2019/021931
§ 371 (c)(1),
(2) Date: Dec. 8, 2020

(87) PCT Pub. No.: WO2020/008771
PCT Pub. Date: Jan. 9, 2020

(65) Prior Publication Data

US 2021/0262355 A1 Aug. 26, 2021

(30) Foreign Application Priority Data

Jul. 2, 2018 (JP) ..... JP2018-126029

(51) Int. Cl.
*F01D 9/04* (2006.01)
*F01D 25/32* (2006.01)

(52) U.S. Cl.
CPC ..... *F01D 9/041* (2013.01); *F01D 9/042* (2013.01); *F01D 25/32* (2013.01);
(Continued)

(58) Field of Classification Search
CPC ..... F01D 9/041; F01D 9/042; F01D 25/24; F05D 2210/13; F05D 2220/31; F05D 2240/12; F05D 2260/602; F05D 2260/608
See application file for complete search history.

(56) References Cited

U.S. PATENT DOCUMENTS 3,921,672 A * 11/1975 Arnold ..... F16L 55/027 138/42
4,759,505 A * 7/1988 Delaplace ..... B05B 7/205 239/600

(Continued)

FOREIGN PATENT DOCUMENTS

JP 59-190403 A 10/1984
JP 62-174503 A 7/1987

(Continued)

OTHER PUBLICATIONS

International Search Report dated Jul. 23, 2019, issued in counterpart Application No. PCT/JP2019/021931, with English translation. (4 pages).

(Continued)

*Primary Examiner* — Igor Kershteyn
(74) *Attorney, Agent, or Firm* — Westerman, Hattori, Daniels & Adrian, LLP

(57) ABSTRACT

A set screw (56) is provided, which has a screw main body (71), a male thread portion (75) which is formed on an outer periphery of the screw main body (71), and a drain hole (78) which penetrates a central portion of the screw main body (71) in an extension direction of the screw main body (71). The blade root ring (53) has a hole (63) which extends radially outward from an inner peripheral surface (53*a*) of the blade root ring (53), and a female thread portion (64) which is formed on an inner peripheral surface (63*a*) of the hole (63), and the set screw (56) is screwed into the female thread portion (64).

6 Claims, 9 Drawing Sheets

(52) U.S. Cl.
CPC ..... *F05D 2220/31* (2013.01); *F05D 2240/12* (2013.01); *F05D 2260/30* (2013.01); *F05D 2260/602* (2013.01)

(56) References Cited

U.S. PATENT DOCUMENTS

| | | | |
|---|---|---|---|
| 2004/0079813 | A1 | 4/2004 | Inoue |
| 2010/0313408 | A1 | 12/2010 | Morio |
| 2017/0159494 | A1 | 6/2017 | Burdgick |

FOREIGN PATENT DOCUMENTS

| | | | |
|---|---|---|---|
| JP | 4-129803 | U | 11/1992 |
| JP | 6-123202 | A | 5/1994 |
| JP | 7-63212 | A | 3/1995 |
| JP | 2004-144251 | A | 5/2004 |
| JP | 2010-507764 | A | 3/2010 |
| JP | 5653659 | B2 | 1/2015 |

OTHER PUBLICATIONS

Written Opinion dated Jul. 23, 2019, issued in counterpart Application No. PCT/JP2019/021931, with English translation. (13 pages).

* cited by examiner

STATOR BLADE SEGMENT AND STEAM TURBINE

TECHNICAL FIELD

The present invention relates to a stator blade segment and a steam turbine.

Priority is claimed on Japanese Patent Application No. 2018-126029, filed Jul. 2, 2018, the content of which is incorporated herein by reference.

BACKGROUND ART

In a low-pressure stage blade train of a steam turbine, performance deterioration (moisture loss) caused by drain condensate generated in wet steam or erosion of a rotor blade caused by the drain colliding with the rotor blade disposed on a downstream side easily occurs.

Accordingly, a steam turbine having a mechanism for removing the drain condensate in the wet steam has been developed (for example, refer to Patent Document 1).

Patent Document 1 discloses a blade root ring which includes a drain groove which is disposed between stator blade roots of an inner wall of the blade root ring and of which a depth becomes deeper from an upstream side to a downstream side, and a drain discharge hole (drain hole) which is provided at the most downstream tail of the drain groove and discharges the drain condensate in a direction from the inner wall to an outer wall of the blade root ring.

CITATION LIST

Patent Literature

Patent Document 1

Japanese Unexamined Utility Model Application, First Publication No. H 4-129803

SUMMARY OF INVENTION

Technical Problem

Meanwhile, from the viewpoint of suppressing outflow of steam from a drain discharge hole, it is preferable to reduce the diameter of the drain discharge hole.

However, in the drain discharge hole disclosed in Patent Document 1, the blade root ring is directly processed by a drill or the like. Accordingly, it is difficult to reduce the diameter of the drain discharge hole.

Therefore, in the technique disclosed in Patent Document 1, it is difficult to form a small drain discharge hole (drain hole) capable of efficiently discharging the drain condensate while suppressing the outflow of steam from the drain discharge hole.

Therefore, an object of the present invention is to provide a stator blade segment and a steam turbine capable of efficiently discharging the drain condensate while suppressing the outflow of steam from the drain hole.

Solution to Problem

In order to solve the above problems, according to an aspect of the present invention, there is provided a stator blade segment including: a blade root ring which extends in a circumferential direction of an axis; a plurality of stator blades which are disposed on an inner peripheral surface of the blade root ring at intervals from each other in the circumferential direction and extend radially inward from the inner peripheral surface of the blade root ring; and a set screw which has a screw main body, a male thread portion which is formed on an outer periphery of the screw main body, and a drain hole which penetrates a central portion of the screw main body in an extension direction of the screw main body, in which the blade root ring has a hole which extends radially outward from the inner peripheral surface of the blade root ring, and a female thread portion which is formed on an inner peripheral surface of the hole, and the set screw is screwed into the female thread portion.

According to the present invention, the set screw is provided, which has the screw main body which is screwed into the female thread portion formed in the hole extending radially outward from the inner peripheral surface of the blade root ring, the male thread portion which is formed on the outer periphery of the screw main body, and the drain hole which penetrates the screw main body in the extension direction of the screw main body. Therefore, compared to a case where the drain hole is directly formed on the blade root ring, it is possible to form the drain hole having a smaller diameter in the screw main body.

Accordingly, outflow of steam from the drain hole can be suppressed, and drain condensate can be efficiently discharged through the drain hole.

Further, in the stator blade segment according to the aspect of the present invention, the blade root ring may have a drain recessed portion which is formed on the inner peripheral surface of the blade root ring located between the stator blades adjacent to each other and collects drain condensate generated in steam, and the hole may extend radially outward from a bottom surface of the drain recessed portion.

In this way, the drain recessed portion which collects the drain condensate generated in the steam is provided, and the hole which extends radially outward from the bottom surface of the drain recessed portion is formed. Accordingly, the drain condensate in the drain recessed portion can be guided to the drain hole. Therefore, the drain condensate can be efficiently discharged through the drain hole.

Further, in the stator blade segment according to the aspect of the present invention, the drain recessed portion may be a drain groove which extends in a circumferential direction of the blade root ring or a direction intersecting the circumferential direction.

In this way, as the drain recessed portion, the drain groove which extends in the circumferential direction of the blade root ring or the direction intersecting the circumferential direction is used. Accordingly, compared to a case where a non-groove recessed portion is formed as the drain recessed portion, the drain condensate can be efficiently collected.

Further, in the stator blade segment according to the aspect of the present invention, the blade root ring may have a drain chamber which is a space disposed radially outside the hole, and the hole may communicate with the drain chamber.

In this way, the hole communicates with the drain chamber, and thus, the drain hole formed in the set screw can communicate with the drain chamber. Accordingly, the drain condensate can be guided to the drain chamber through the drain hole.

Further, in the stator blade segment according to the aspect of the present invention, the female thread portion may be formed on an inner peripheral surface side of the blade root ring in the hole, the length of the female thread portion may be shorter than the length of the hole in an extension direction of the hole, and a recessed portion into which a distal end of a tool used for screwing the set screw into the female thread portion is inserted and which communicates with the drain hole may be formed on an end of the set screw located on the inner peripheral surface side of the blade root ring.

In this way, the female thread portion is formed on the drain groove side of the hole, the length of the female thread portion is shorter than the length of the hole in the extension direction of the hole, and the recessed portion into which a distal end of a tool used for screwing the set screw can be inserted is formed on the end of the set screw located on the inner peripheral surface side of the blade root ring. Accordingly, it is possible to screw the set screw into the female thread portion using the tool from the inner peripheral surface side of the blade root ring.

Further, the female thread portion is formed in a portion of the hole located on the inner peripheral surface side of the blade root ring, and thus, a portion of the hole of a side on which the female thread portion is not formed can function as a stopper for regulating the position of a radially outer end of the set screw.

Further, the recessed portion is formed so as to communicate with the drain hole, and thus, the drain condensate can be guided to the drain hole through the recessed portion.

Further, in the stator blade segment according to the aspect of the present invention, the lengths of the set screw and the male thread portion may be shorter than the length of the female thread portion, the blade root ring may have a plastic deformation portion in which a portion of the bottom surface of the drain recessed portion for partitioning the hole is plastically deformed in a direction toward a central axis of the hole, and the plastic deformation portion may abut on an end portion of the set screw disposed on an inside in a radial direction.

In this way, the lengths of the set screw and the male thread portion are shorter than the length of the female thread portion. Accordingly, it is possible to shorten the length of the drain hole having a small diameter. Therefore, the drain condensate can easily pass through the drain hole.

Further, the lengths of the set screw and the male thread portion are shorter than the length of the female thread portion, and thus, an end surface of the screw main body disposed on the inner peripheral surface side of the blade root ring can be disposed inside the hole.

Further, the plastic deformation portion is provided in which the portion of the bottom surface of the drain recessed portion for partitioning the hole is plastically deformed in the direction toward the central axis of the hole, and the plastic deformation portion abuts on the end portion of the set screw disposed on the inside in the radial direction. Accordingly, the position of a radially inner end of the set screw with respect to the hole can be regulated.

Further, according to another aspect of the present invention, there is provided a steam turbine including: the stator blade segment; a rotor which has a rotating shaft which is disposed so as to penetrate a space formed in a center of the stator blade segment and rotates with the axis as a central axis, and a plurality of rotor blades which are provided on the rotating shaft at intervals from each other in a circumferential direction of the rotating shaft and extend radially outward; and a casing which has a tubular shape with the axis as a central axis and has the stator blade segment provided on an inner peripheral surface.

According to the present invention, the steam turbine has the stator blade segment, and thus, it is possible to efficiently discharge the drain condensate while suppressing outflow of steam from the drain hole. Therefore, a driving state of the steam turbine can be stably maintained in a good condition.

Advantageous Effects of Invention

According to the present invention, it is possible to efficiently discharge drain condensate while suppressing outflow of steam from the drain hole.

DESCRIPTION OF EMBODIMENTS

Hereinafter, an embodiment to which the present invention is applied will be described in detail with reference to the drawings.

Embodiment

Figure 1:
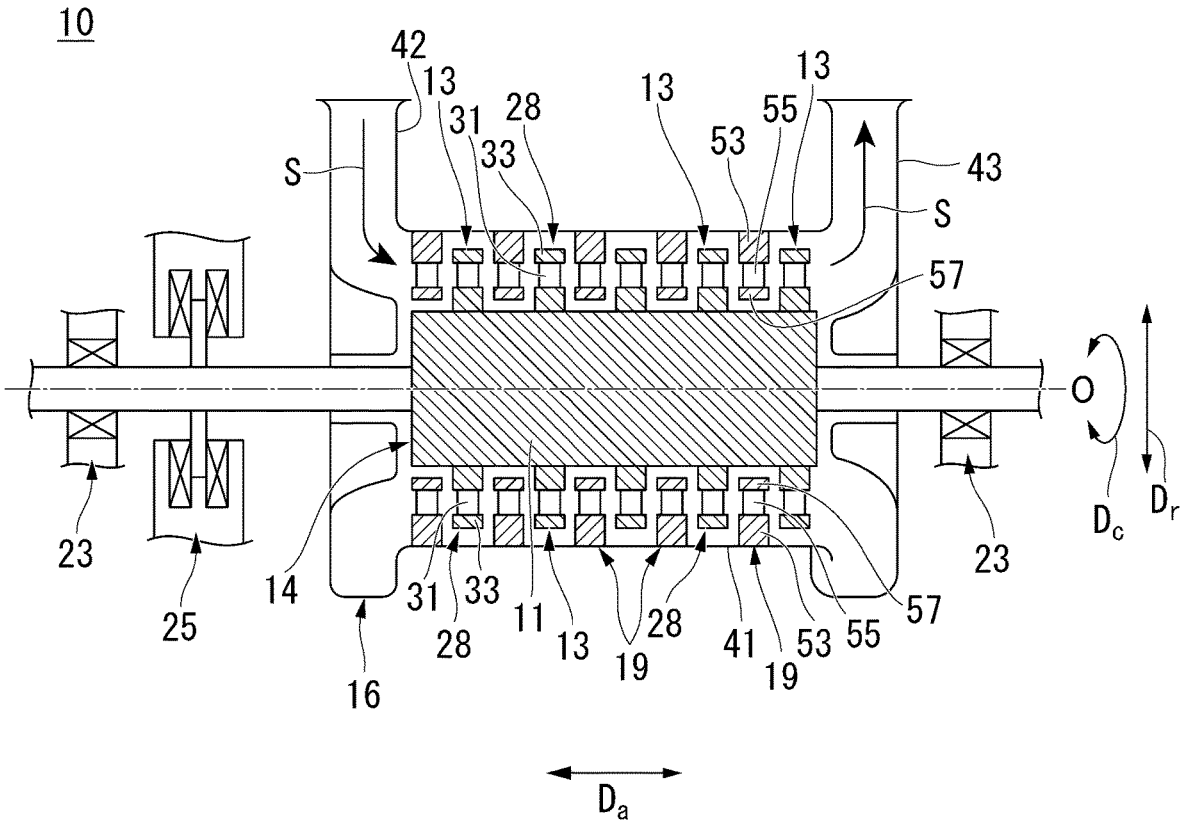
FIG. 1 is a cross-sectional view schematically illustrating a schematic configuration of a steam turbine according to an embodiment of the present invention.

A steam turbine 10 of the present embodiment will be described with reference to FIG. 1. In FIG. 1, O is an axis (hereinafter, referred to as an "axis O") of a rotating shaft 11, DA is a direction (hereinafter, referred to as an "axial direction DA") in which the axis O of the rotating shaft 11 extends, Dc is a circumferential direction (hereinafter, referred to as a "circumferential direction Dc") of the axis O of the rotating shaft 11, Dr is a radial direction (hereinafter, referred to as a "radial direction Dr") of the rotating shaft 11, and arrows indicate a movement direction of steam S.

The steam turbine 10 includes a rotor 14 which has the rotating shaft 11 and a plurality of rotor blade groups 13, a casing 16, a plurality of stator blade segments 19, a journal bearing 23, and a thrust bearing 25.

The rotating shaft 11 extends in the axial direction DA. In a state where both end portions of the rotating shaft 11 are disposed outside the casing 16, a portion located between one end portion and the other end portion is accommodated in the casing 16.

The rotor blade group 13 is fixed to a surface of an outer periphery of the rotating shaft 11 accommodated in the casing 16. The rotor blade group 13 has a plurality of rotor blades 28 which are disposed at intervals in the circumferential direction Dc of the rotating shaft 11. The plurality of rotor blade groups 13 are disposed at intervals in the axial direction DA.

The rotor blade 28 has a blade main body 31 and a rotor blade shroud 33. The blade main body 31 extends radially outward (an outside in the radial direction Dr) from the outer periphery of the rotating shaft 11.

The rotor blade shroud 33 is provided on a distal end of the blade main body 31. A contact surface of the rotor blade shroud 33 abuts on a contact surface of another rotor blade shroud 33 disposed adjacent to each other in the circumferential direction Dc.

The casing 16 has a casing main body 41, a steam supply pipe 42, and a steam discharge pipe 43.

The casing main body 41 is a tubular member extending in the axial direction DA. The casing main body 41 accommodates the plurality of rotor blade groups 13 and a portion of the rotating shaft 11 in which the plurality of rotor blade groups 13 are provided.

The steam supply pipe 42 is provided on one side of the casing main body 41 in the axial direction DA. The steam supply pipe 42 functions as a steam introduction port for taking steam S into the casing main body 41.

The steam discharge pipe 43 is provided on the other side of the casing main body 41 in the axial direction DA. The steam discharge pipe 43 functions as a steam discharge port for discharging the steam S to the outside of the casing main body 41.

The plurality of stator blade segments 19 are provided along an inner peripheral surface of the casing main body 41. The plurality of stator blade segments 19 are disposed at intervals in the axial direction DA. In the axial direction DA, one rotor blade group 13 is disposed between the stator blade segments 19 adjacent to each other.

Figure 2:
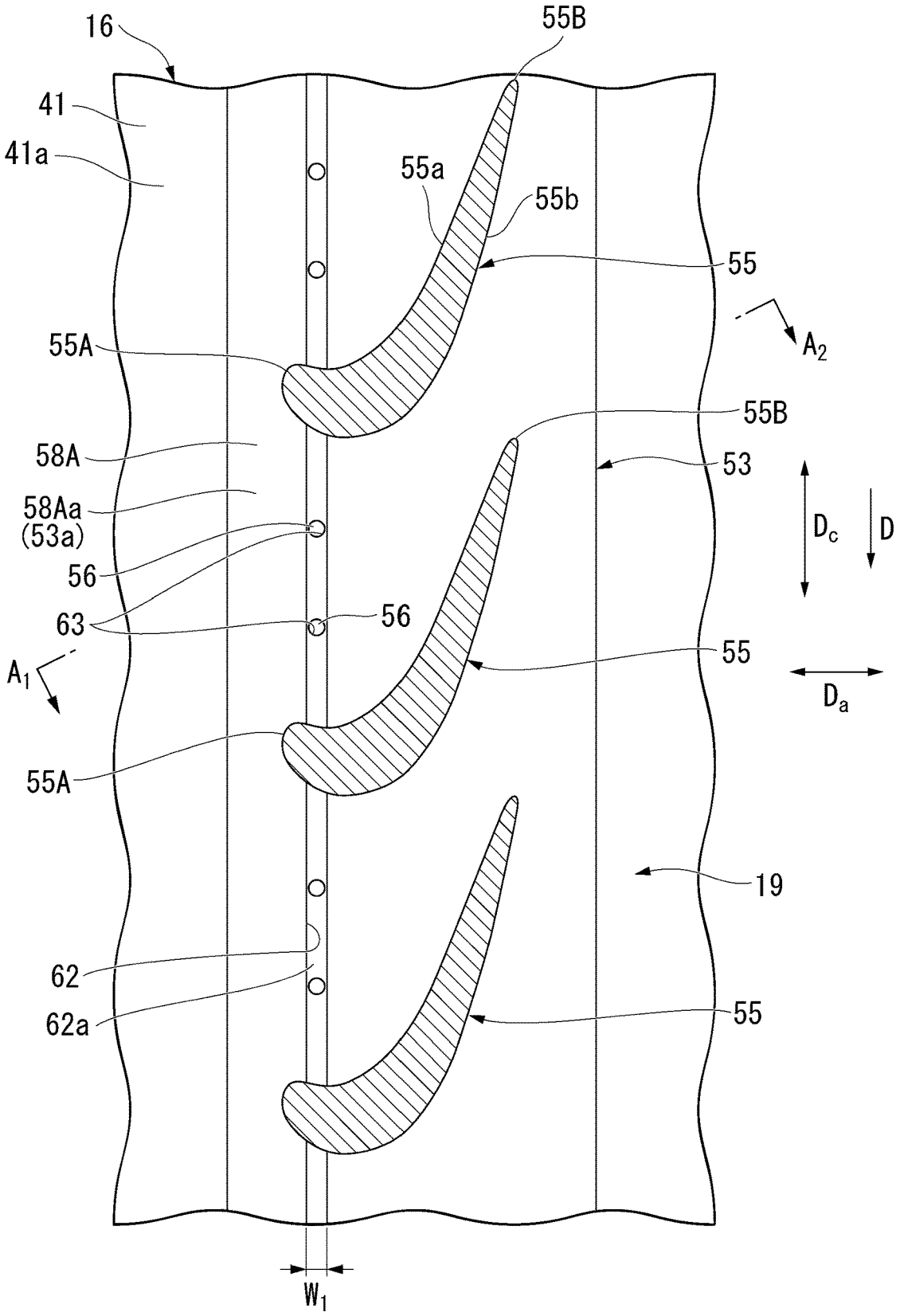
FIG. 2 is a view when a stator blade segment and a casing illustrated in FIG. 1 are viewed from an inside in a radial direction, and is a view illustrating blade main bodies of a plurality of stator blades in cross section.

Here, a specific configuration of the stator blade segment 19 will be described with reference to FIGS. 1 to 7. In FIG. 2, illustration of an internal structure of a stator blade 48 is omitted. Further, in FIG. 2, D indicates a rotation direction of the rotating shaft 11 illustrated in FIG. 1, and $W_1$ indicates a width (hereinafter, referred to as a "width $W_1$") of a drain groove 62 in the axial direction DA, respectively.

Figure 3:
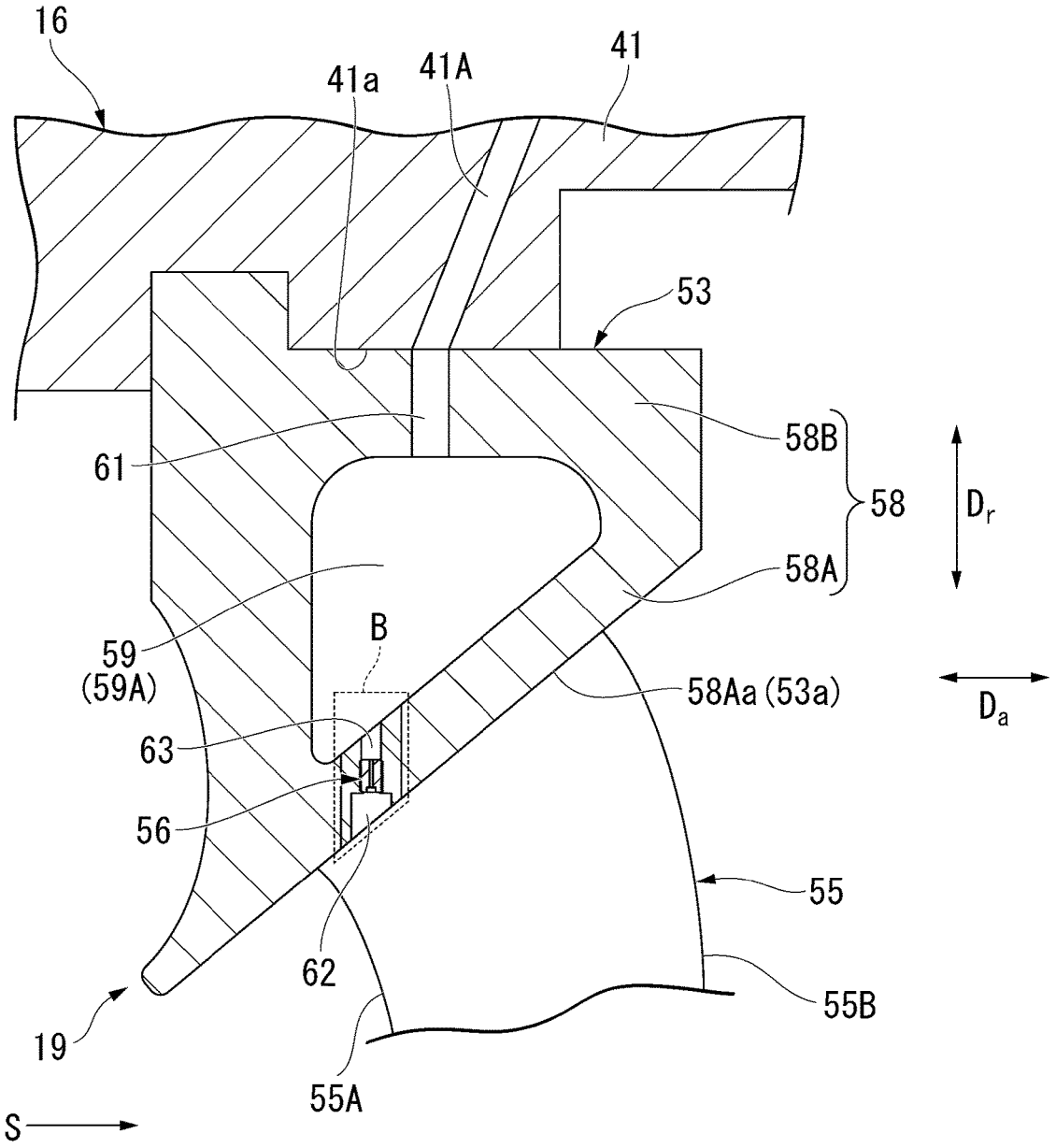
FIG. 3 is a cross-sectional view of the stator blade segment and the casing illustrated in FIG. 2 taken along line $A_1$-$A_2$.
Figure 4:
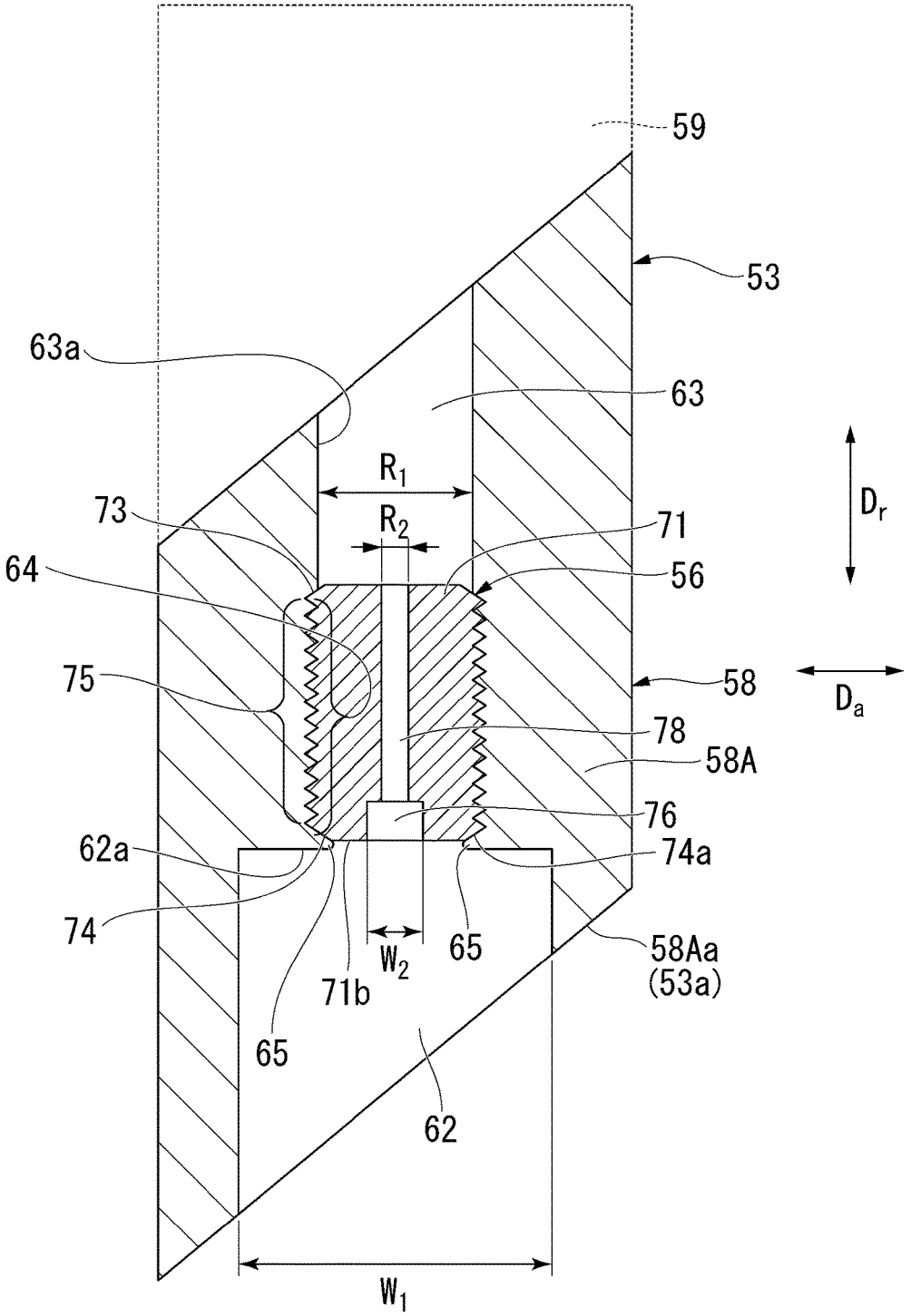
FIG. 4 is an enlarged cross-sectional view of a portion of the stator blade segment illustrated in FIG. 3 surrounded by a region B.

In FIG. 3, B indicates a region. In FIG. 4, $R_1$ indicates a diameter (hereinafter, referred to as a "diameter $R_1$") of a hole 63, $R_2$ indicates a diameter (hereinafter, referred to as a "diameter $R_2$") of a drain hole 78, and $W_2$ indicates a width (hereinafter, referred to as a "width $W_2$") of a recessed portion 76, respectively.

Figure 5:
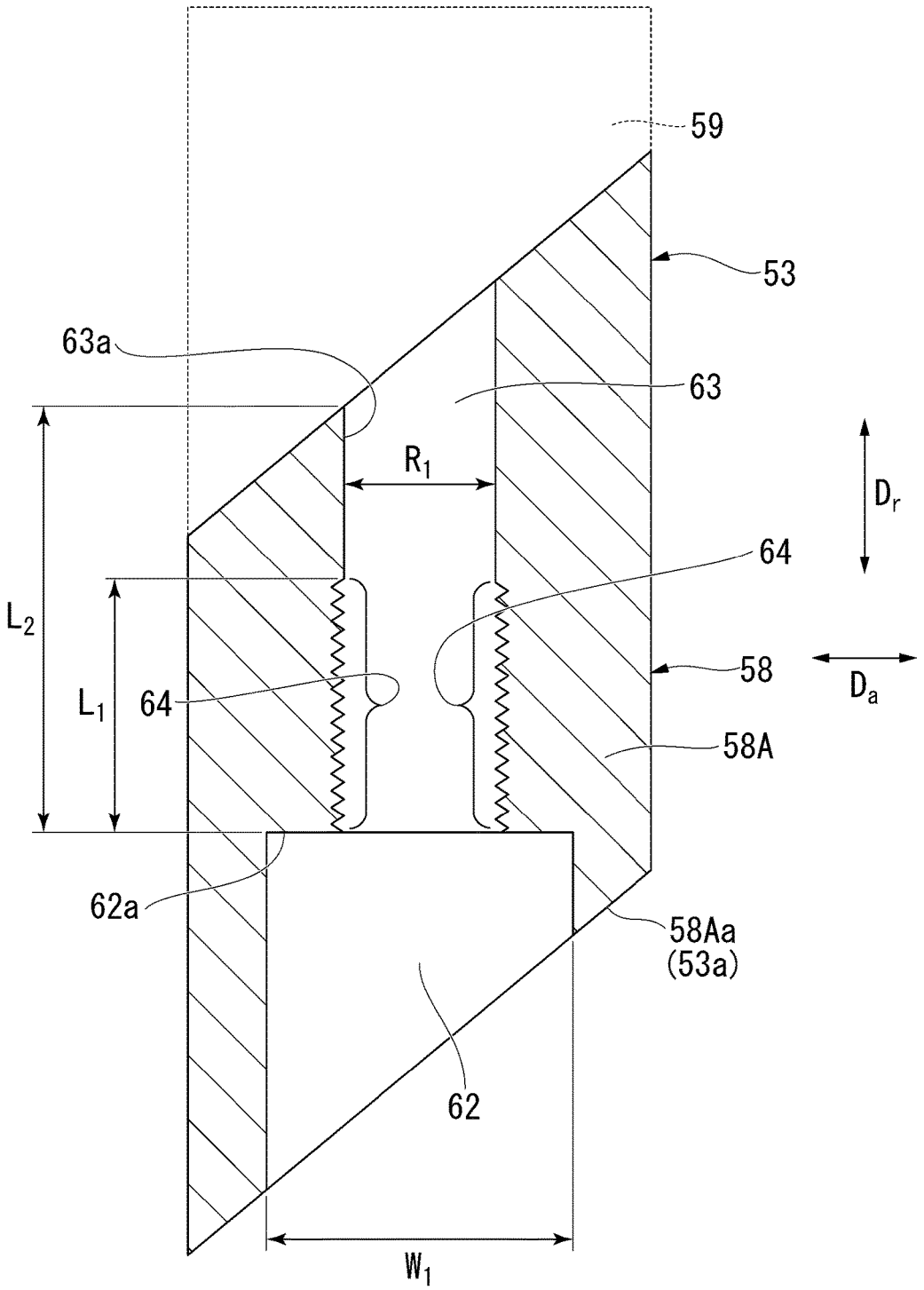
FIG. 5 is a cross-sectional view illustrating a blade root ring before the set screw illustrated in FIG. 4 is screwed.

In FIG. 5, $L_1$ indicates the length of a female thread portion 64 in an extension direction of the hole 63, and $L_2$ indicates the length (hereinafter, referred to as the "length $L_2$") of the shortest portion of the hole 63, respectively.

Figure 6:
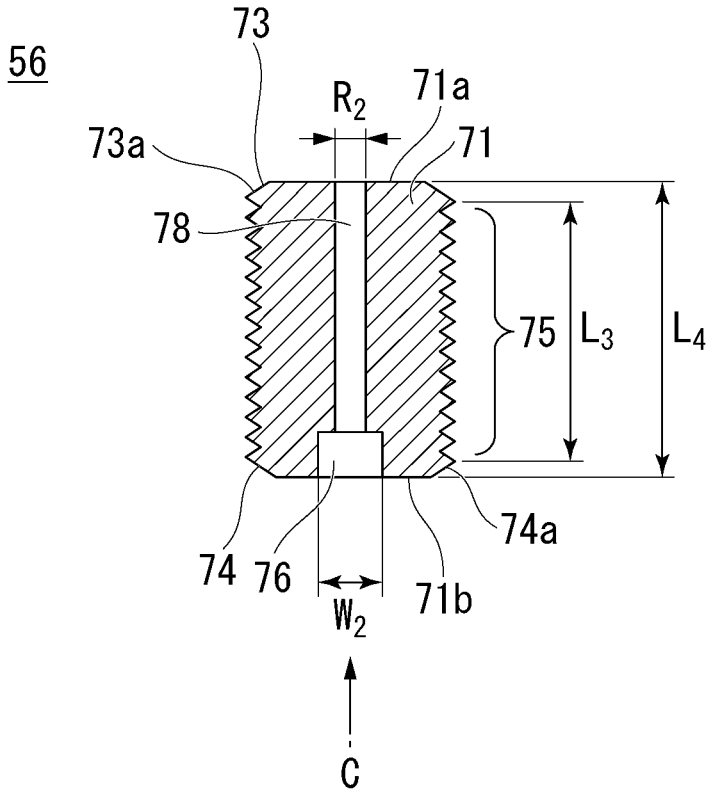
FIG. 6 is a cross-sectional view illustrating only the set screw illustrated in FIG. 4.

In FIG. 6, $L_3$ indicates the length of a male thread portion 75 in the extension direction of the hole 63, and $L_4$ indicates the length (hereinafter, referred to as the "length $L_4$") of a set screw 56, respectively.

In addition, in FIGS. 1 to 7, the same components are designated by the same reference signs.

The stator blade segment 19 has a blade root ring 53, a plurality of stator blades 55, the set screw 56, and a plurality of stator blade shrouds 57.

The blade root ring 53 is a ring-shaped member extending in the circumferential direction Dc. The blade root ring 53 is fitted to a portion of an inner peripheral surface 41A of the casing main body 41 corresponding to a drain discharge flow path 41A formed in the casing main body 41. One end of the drain discharge flow path 41A is exposed from the inner peripheral surface 41A of the casing main body 41.

A groove for fitting a plurality of stator blades 55 at intervals in the circumferential direction Dc is formed on an inner peripheral surface of the blade root ring 53.

The blade root ring 53 includes a blade root ring main body 58, a drain chamber 59, a communication hole 61, a drain groove 62 which is a drain recessed portion, a hole 63, the female thread portion 64, and a plastic deformation portion 65.

The blade root ring main body 58 has a configuration in which a first ring-shaped member 58A and a second ring-shaped member 58B are joined to each other.

The first ring-shaped member 58A is a ring-shaped plate material, and has an inner peripheral surface 58AA which is an inclined surface inclined with respect to the axial direction DA and the radial direction Dr. The inner peripheral surface 58AA is a surface corresponding to an inner peripheral surface 53A of the blade root ring 53.

The second ring-shaped member 58B is joined to an outer peripheral surface side of the first ring-shaped member 58A. The second ring-shaped member 58B is fitted to the inner peripheral surface side of the casing main body 41.

The second ring-shaped member 58B has a ring-shaped recessed portion 59A on a side facing the first ring-shaped member 58A. The first ring-shaped member 58A and the second ring-shaped member 58B are joined to each other, and thus, the recessed portion 59A becomes the drain chamber 59.

The drain chamber 59 is a ring-shaped space, and is formed between the first ring-shaped member 58A and the second ring-shaped member 58B.

The communication hole 61 is formed so as to penetrate a second ring-shaped member 58B located between one end of the drain discharge flow path 41A and the drain chamber 59.

Accordingly, the one end of the drain discharge flow path 41A with the drain chamber 59 communicate with each other through the communication hole 61.

The drain groove 62 is formed on the inner peripheral surface 58AA of the first ring-shaped member 58A located between the stator blades 55 adjacent to each other in the circumferential direction Dc.

The drain groove 62 is arranged on leading edges 55A side of the stator blades 55 adjacent to each other and extends in the circumferential direction Dc. The drain groove 62 is a groove which is recessed from the inner peripheral surface 58AA of the first ring-shaped member 58A to the casing main body 41.

The width $W_1$ of the drain groove 62 in the axial direction DA can be appropriately set, but can be 10.5 mm, for example.

The drain groove 62 having this configuration is provided, drain condensate generated in the wet steam can be collected in the drain groove 62.

The hole 63 extends radially outward from a bottom surface 62A of the drain groove 62 and reaches the drain chamber 59. In a state (state illustrated in FIG. 5) where the set screw 56 is not disposed in the hole 63, the drain groove 62 and the drain chamber 59 communicate with each other through the hole 63.

The hole 63 exists on the inner peripheral surface 58AA side of the first ring-shaped member 58A, and guides the drain condensate guided into the drain groove 62 into the drain chamber 59.

The diameter $R_1$ of the hole 63 is configured to be smaller than the width $W_1$ of the drain groove 62. When the width $W_1$ of the drain groove 62 is 10.5 mm, for example, the diameter $R_1$ of the hole 63 can be 8.5 mm.

The female thread portion 64 is a portion to which the set screw 56 is screwed, and is formed on an inner peripheral surface 63A of the hole 63. The female thread portion 64 is formed only in a portion of the hole 63 located on the inner peripheral surface 58AA side of the first ring-shaped member 58A. That is, the female thread portion 64 is not formed in a portion of the hole 63 located on the drain chamber 59 side.

Accordingly, the length $L_1$ of the female thread portion 64 in the extension direction of the hole 63 is shorter than the length $L_2$ of the hole 63.

In this way, the female thread portion 64 is formed only in the portion of the hole 63 located on the inner peripheral surface 58AA side of the first ring-shaped member 58A, and thus, the set screw 56 can be screwed into the female thread portion 64 from the inner peripheral surface side of the blade root ring 53. Accordingly, when a construction where the set screw 56 is screwed into the female thread portion 64 is performed, it is possible to prevent the drain chamber 59 from interfering with the construction.

Further, the female thread portion 64 is formed only in the portion of the hole 63 located on the inner peripheral surface 58AA side of the first ring-shaped member 58A. Accordingly, the portion of the hole 63 which is disposed on the drain chamber 59 side and in which the female thread portion 64 is not formed can function as a stopper for regulating the position of the set screw 56 on the outside in the radial direction.

The plastic deformation portion 65 is provided around an end of the hole 63 (female thread portion 64) located on the rotating shaft 11 side.

After the set screw 56 is screwed into the female thread portion 64, the first ring-shaped member 58A of the bottom surface 62A of the drain groove 62 for partitioning the hole 63 (female thread portion 64) is plastically deforming in a direction toward a central axis of the hole 63 (female thread portion 64), and thus, the plastic deformation portion 65 is formed.

That is, the plastic deformation portion 65 is not formed in a step before the set screw 56 is screwed into the female thread portion 64.

For example, the plastic deformation portion 65 can be formed by caulking the first ring-shaped member 58A of the bottom surface 62A of the drain groove 62 for partitioning the hole 63 (female thread portion 64).

The plastic deformation portion 65 abuts on a chamfered portion 74 (end portion of the set screw 56) of the set screw 56 which is disposed radially inward in a state where the set screw 56 is screwed into the female thread portion 64.

In this way, the plastic deformation portion 65 is provided in which the first ring-shaped member 58A of the bottom surface 62A of the drain groove 62 for partitioning the hole 63 (female thread portion 64) is plastically deformed in the direction toward the central axis of the hole 63 (female thread portion 64). Accordingly, the plastic deformation portion 65 abuts on the chamfered portion 74 of the set screw 56, and thus, the position of a radially inner end of the set screw 56 with respect to the hole 63 can be regulated.

The plurality of stator blades 55 are arranged on the inner peripheral surface 58AA of the first ring-shaped member 58A at intervals in the circumferential direction Dc. The plurality of stator blades 55 extend radially inward from the inner peripheral surface 58AA of the first ring-shaped member 58A.

The stator blade 55 has a pressure side 55A, a suction side 55*b*, a leading edge 55A, and a trailing edge 55B.

The suction side 55*b* is disposed on a side opposite to the pressure side 55A. The leading edge 55A is disposed on an upstream side in a flow direction of the steam S, and connects the pressure side 55A and the suction side 55*b* to each other.

The trailing edge 55B is disposed on a downstream side in the flow direction of the steam S, and connects the pressure side 55A and the suction side 55*b* to each other.

The set screw 56 has a screw main body 71, chamfered portions 73 and 74, a male thread portion 75, a recessed portion 76, and a drain hole 78.

The screw main body 71 is a member having a columnar shape. The screw main body 71 has an end surface 71A which is a plane disposed at one end and an end surface 71*b* which is a plane disposed at the other end.

The chamfered portion 73 is formed on an outer peripheral portion of one end. The chamfered portion 73 has a ring-shaped inclined surface 73A which is inclined with respect to the end surface 71A. The inclined surface 73A is disposed so as to surround the end surface 71A.

The chamfered portion 74 is formed on an outer peripheral portion of the other end. The chamfered portion 74 has a ring-shaped inclined surface 74A which is inclined with respect to the end surface 71*b*. The inclined surface 74A is disposed so as to surround the end surface 71*b*.

The male thread portion 75 is formed on an outer periphery of the screw main body 71 disposed between the chamfered portion 73 and the chamfered portion 74. As a result, the length $L_3$ of the male thread portion 75 in an extension direction of the set screw 56 is shorter than the length $L_4$ of the set screw 56.

Further, the length $L_3$ of the male thread portion 75 and the length $L_4$ of the set screw 56 are configured to be shorter than the length $L_1$ of the female thread portion 64.

In this way, the length $L_3$ of the male thread portion 75 and the length $L_4$ of the set screw 56 are shorter than the length $L_1$ of the female thread portion 64. Accordingly, in a state where the set screw 56 is screwed into the female thread portion 64, the end surface 71*b* of the screw main body 71 can be disposed inside the hole 63. As a result, it is possible to secure a region in which the above-mentioned plastic deformation portion 65 is disposed.

The recessed portion 76 is formed on a side of the end surface 71*b* of the screw main body 71 so as to be recessed from the end surface 71*b* toward a side of the end surface 71A. The recessed portion 76 has a shape (a shape corresponding to a distal end of a tool) into which the distal end (not illustrated) of the tool used for screwing the set screw 56 into the female thread portion 64 can be inserted.

In this way, the recessed portion 76 into which the distal end of the tool used for screwing the set screw 56 into the female thread portion 64 can be inserted is provided on the end of the set screw 56 located on the inner peripheral surface 53A side of the blade root ring 53. Accordingly, the set screw 56 can be screwed into the female thread portion 64 by using the tool from the inner peripheral surface 53A side of the blade root ring 53.

Figure 7:
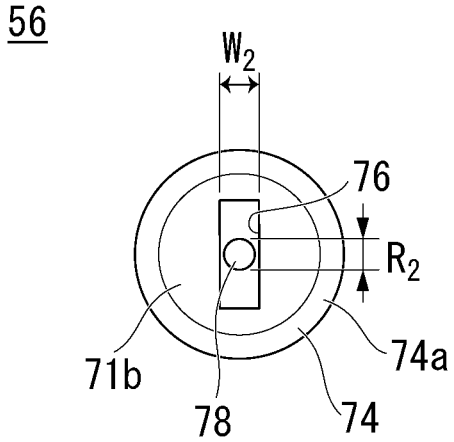
FIG. 7 is a view when the set screw illustrated in FIG. 6 is viewed from C.

In addition, in FIGS. 4, 6 and 7, as an example of the recessed portion 76, a minus groove into which a distal end of a flat-blade screwdriver (an example of a tool) can be inserted is taken as an example, but a shape of the recessed portion 76 can be appropriately selected according to a shape of a distal end of a tool to be used.

For example, when a Phillips screwdriver is used as the tool, the shape of the recessed portion 76 can be formed into a cross groove.

The drain hole 78 is formed so as to penetrate a central portion of the screw main body 71, in which the recessed portion 76 is formed, in the extension direction of the screw main body 71. Accordingly, the drain hole 78 communicates with the recessed portion 76.

The drain hole 78 is a hole for guiding the drain condensate guided into the recessed portion 76 through the drain groove 62 to the drain chamber 59.

The diameter $R_2$ of the drain hole 78 is configured to be smaller than the width $W_2$ of the recessed portion 76. A size of the diameter $R_2$ of the drain hole 78 can be appropriately set, but can be 3 mm, for example. The hole having the diameter $R_2$ of 3 mm is a small hole which is difficult to directly machine into the blade root ring 53.

Thus, by reducing the diameter $R_2$ of the drain hole 78, it is possible to suppress steam flowing to the drain chamber 59 side through the drain hole 78.

As described above, the length $L_4$ of the set screw 56 is configured to be shorter than the length $L_2$ of the hole 63. As a result, the length of the drain hole 78 is shorter than the length $L_2$ of the hole 63 and the length $L_4$ of the set screw 56.

Therefore, the length of the drain hole 78 is shorter than the length $L_2$ of the hole 63 and the length $L_4$ of the set screw 56, and thus, the length of the drain hole 78 is shortened. Accordingly, the drain condensate can be easily moved from the recessed portion 76 to the drain chamber 59 through the drain hole 78.

The stator blade shroud 57 is provided on a distal end of each stator blade 55. A contact surface of the stator blade shroud 57 abuts on a contact surface of another stator blade shroud 57 disposed adjacent to each other in the circumferential direction Dc.

The journal bearings 23 supports both end portions of the rotating shaft 11, respectively. The journal bearing 23 supports a load in the radial direction Dr. The thrust bearing 25 is disposed only on one side of the axial direction DA of the rotating shaft 11. The thrust bearing 25 supports the rotating shaft 11 from the axial direction DA.

After the steam S is supplied into the casing main body 41 through the steam supply pipe 42, the steam S passes through gaps between the plurality of stator blade segments 19 and the plurality of rotor blade groups 13 as the rotating shaft 11 rotate, and is discharged to the outside of the casing 16 via the steam discharge pipe 43.

According to the stator blade segment 19 of the present embodiment, the set screw 56 is provided, which includes the screw main body 71 which is screwed into the female thread portion 64 formed in the hole 63 extending radially outward from the inner peripheral surface 53A of the blade root ring 53, the male thread portion 75 which is formed on the outer periphery of the screw main body 71, and the drain hole 78 which penetrates the screw main body 71 in the extension direction thereof. Accordingly, compared to a case where the drain hole 78 is directly formed on the blade root ring 53, it is possible to form the drain hole 78 having a smaller diameter in the screw main body 71.

Accordingly, the outflow of the steam S from the drain hole 78 can be suppressed, and the drain condensate can be efficiently discharged through the drain hole 78.

Further, according to the steam turbine 10 having the stator blade segment 19, the outflow of steam S from the drain hole 78 can be suppressed, and the drain condensate can be efficiently discharged through the drain hole 78. Therefore, a driving state of the steam turbine 10 can be stably maintained in a good condition.

Figure 8:
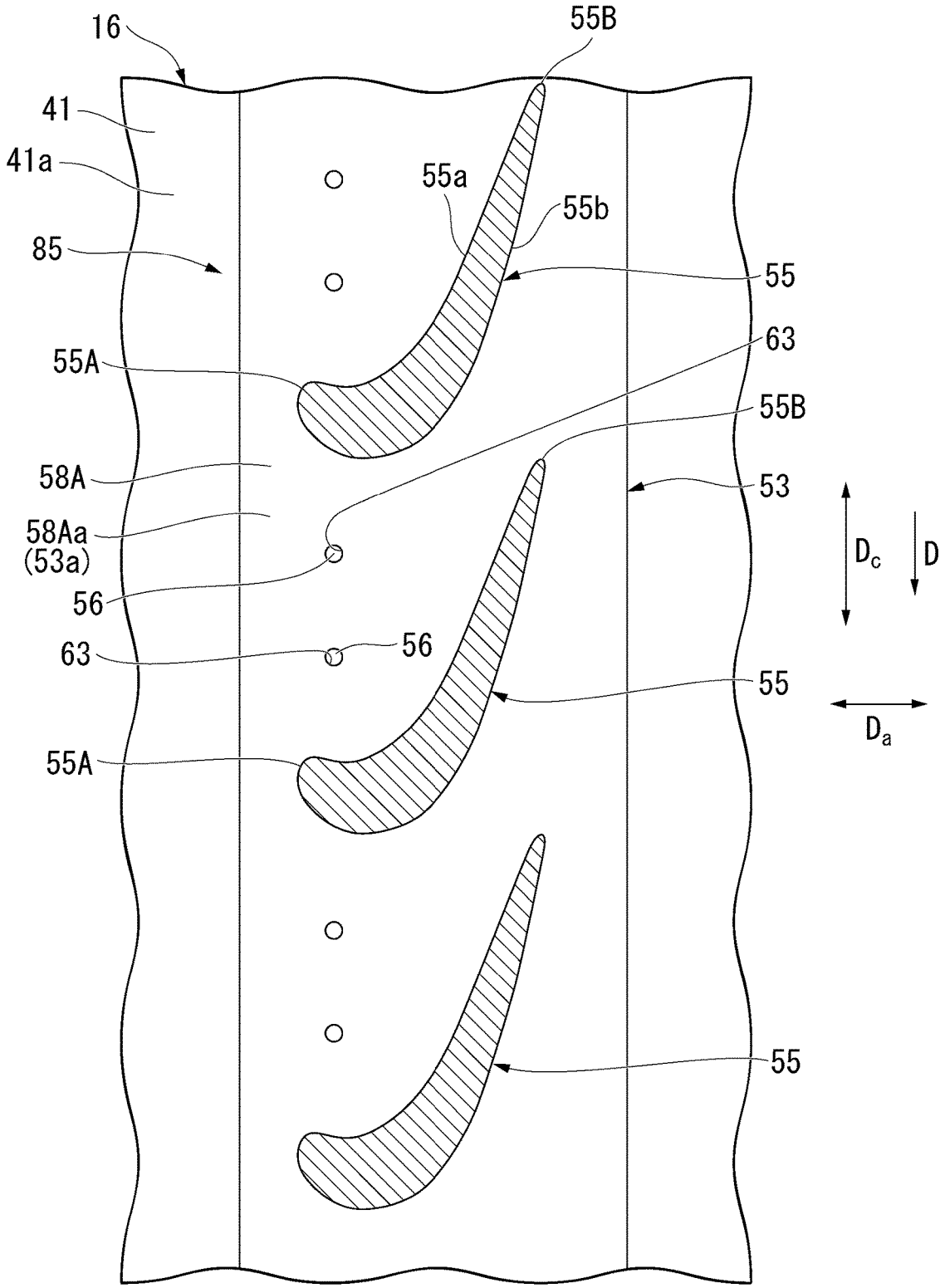
FIG. 8 is a view when a stator blade segment and a casing according to a first modification example of the embodiment of the present invention are viewed from the inside in the radial direction, and is a view illustrating blade main bodies of a plurality of stator blades in cross section.

Next, a stator blade segment 85 according to a first modification example of the embodiment of the present invention will be described with reference to FIG. 8. In FIG. 8, the same components as those of the structure illustrated in FIG. 2 are designated by the same reference signs.

The stator blade segment 85 according to the first modification example is configured in the same manner as the stator blade segment 19 except that the drain groove 62 constituting the stator blade segment 19 described above is removed from components.

As illustrated in FIG. 4 described above, the set screw 56 includes the recessed portion 76 formed to communicate with the drain hole 78, and thus, it is possible to collect the drain condensate in the recessed portion 76.

Therefore, even when the drain groove 62 illustrated in FIG. 2 is not formed, effects of suppressing the outflow of the steam S from the drain hole 78 and efficiently discharging the drain condensate through the drain hole 78 can be realized.

The number and disposition of the holes 63 and the set screws 56 illustrated in FIG. 8 are examples and the present invention is not limited thereto. The number and disposition of the holes 63 and the set screws 56 can be appropriately set.

Figure 9:
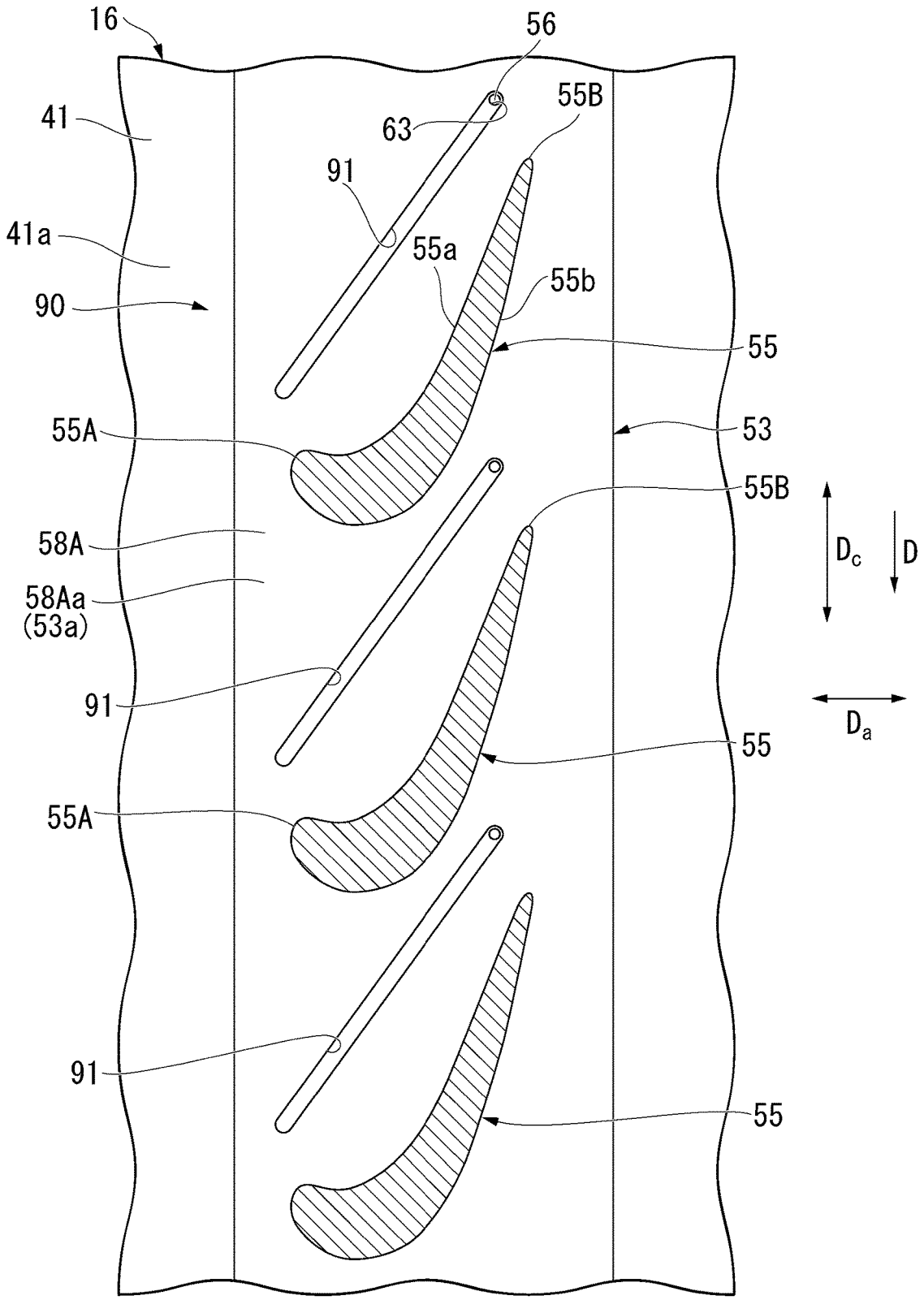
FIG. 9 is a view when a stator blade segment and a casing according to a second modification example of the embodiment of the present invention are viewed from the inside in the radial direction, and is a view illustrating blade main bodies of a plurality of stator blades in cross section.

Next, a stator blade segment 90 according to a second modification example of the embodiment of the present invention will be described with reference to FIG. 9. In FIG. 9, the same components as those of the structure illustrated in FIG. 2 are designated by the same reference signs.

The stator blade segment 90 according to the second modification example is configured in the same manner as the stator blade segment 19 except that a drain groove 91 is provided instead of the drain groove 62 constituting the stator blade segment 19 described above, one hole 63 is formed on an end, which is located on the trailing edge 55B side of the stator blade 55, of both ends of the drain groove 91, and the set screw 56 is screwed into the female thread portion 64 of the hole 63.

The drain groove 91 is a groove which extends in a direction inclined with respect to the circumferential direction Dc and the axial direction DA. One hole 63 is formed on the end, which is located on the trailing edge 55B side of the stator blade 55, of both ends of the drain groove 91, and the set screw 56 is disposed in the hole 63. Accordingly, the drain condensate flowing along the drain groove 91 in a direction from the leading edge 55A toward the trailing edge 55B can be efficiently guided to the drain hole 78 (see FIG. 6).

The direction in which the drain groove 91 extends may be inclined with respect to the circumferential direction Dc, and is not limited to the extension direction of the drain groove 91 illustrated in FIG. 9. Further, in FIG. 9, the case where one hole 63 is formed on a bottom surface of the drain groove 91 and the set screw 56 is disposed in the hole 63 is described as an example. However, a plurality of the holes 63 and a plurality of set screws 56 may be provided.

Figure 10:
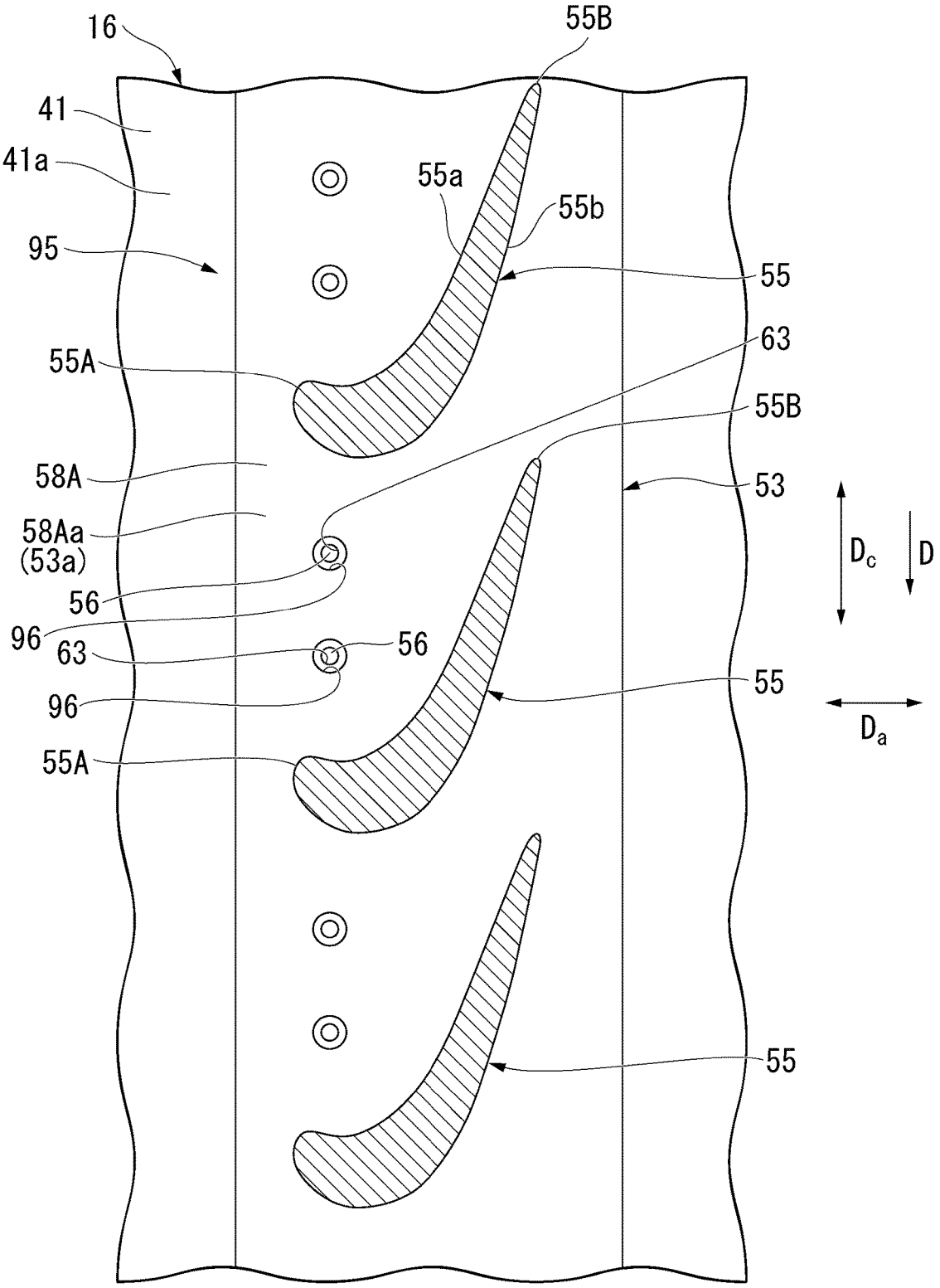
FIG. 10 is a view when a stator blade segment and a casing according to a third modification example of the embodiment of the present invention are viewed from the inside in the radial direction, and is a view illustrating blade main bodies of a plurality of stator blades in cross section.

Next, a stator blade segment 95 according to a third modification example of the embodiment of the present invention will be described with reference to FIG. 10. In FIG. 10, the same components as those of the structure illustrated in FIG. 8 are designated by the same reference signs.

The stator blade segment 95 according to the third modification example is configured in the same manner as the stator blade segment 85 describe above except that a drain recessed portion 96 is further provided in the configuration of the stator blade segment 85 described above.

The drain recessed portion 96 is a columnar recessed portion which is recessed to the casing main body 41A side.

The set screw 56 is disposed in a direction from a bottom surface of the drain recessed portion 96 toward the casing main body 41A.

The stator blade segment 95 having the configuration can collect the drain condensate in the drain recessed portion 96.

Hereinbefore, the preferred embodiments of the present invention are described in detail. However, the present invention is not limited to these specific embodiments, and various modifications and changes can be applied within a scope of a gist of the present invention described in claims.

INDUSTRIAL APPLICABILITY

The present invention can be applied to a stator blade segment and a steam turbine.

REFERENCE SIGNS LIST

10 Steam turbine
11 Rotating shaft
13 Rotor blade group
14 Rotor
16 Casing
19,85,90,95 Stator blade segment
23 Journal bearing
25 Thrust bearing
28 Rotor blade
31 Blade main body
33 Rotor blade shroud
41 Casing main body
41*a*, 53*a*, 58Aa, 63*a* Inner peripheral surface
41A Drain discharge flow path
42 Steam supply pipe
43 Steam discharge pipe
53 Blade root ring
55 Stator blade
55*a* Pressure side
55A Leading edge
55*b* Suction side
55B Trailing edge
56 Set screw
57 Stator blade shroud
58 Blade root ring main body
58A First ring-shaped member
58B Second ring-shaped member
59 Drain chamber
59A, 76 Recessed portion
61 Communication hole
62,91 Drain groove
62*a* Bottom surface
63 Hole
64 Female thread portion
65 Plastic deformation portion
71 Screw main body
71*a*, 71*b* End surface
73,74 Chamfered portion
73*a*, 74*a* Inclined surface
75 Male thread portion
78 Drain hole
96 Drain recessed portion
B Region
D Rotation direction
Da Axial direction
Dc Circumferential direction
Dr Radial direction
$L_1$ to $L_4$ Length
$R_1$, $R_2$ Diameter
S Steam
$W_1$, $W_2$ Width

What is claimed is:

1. A stator blade segment comprising:

a blade root ring which extends in a circumferential direction of an axis;

a plurality of stator blades which are disposed on an inner peripheral surface of the blade root ring at intervals from each other in the circumferential direction and extend radially inward from the inner peripheral surface of the blade root ring; and a set screw which has a screw main body, a male thread portion which is formed on an outer periphery of the screw main body, and a drain hole which penetrates a central portion of the screw main body in an extension direction of the screw main body, wherein the blade root ring has a hole which extends radially outward from the inner peripheral surface of the blade root ring, and a female thread portion which is formed on an inner peripheral surface of the hole, the set screw is screwed into the female thread portion, the blade root ring has a drain recessed portion which is formed on the inner peripheral surface of the blade root ring located between the stator blades adjacent to each other and collects drain condensate generated in steam, the hole extends radially outward from a bottom surface of the drain recessed portion, and an end surface of the screw main body located on the drain recessed portion side is disposed inside the hole.

2. The stator blade segment according to claim 1, wherein the drain recessed portion is a drain groove which extends in a circumferential direction of the blade root ring or a direction intersecting the circumferential direction.

3. The stator blade segment according to claim 1, wherein the blade root ring has a drain chamber which is a space disposed radially outside the hole, and the hole communicates with the drain chamber.

4. The stator blade segment according to claim 1, wherein the female thread portion is formed on an inner peripheral surface side of the blade root ring in the hole, a length of the female thread portion is shorter than a length of the hole in an extension direction of the hole, and a recessed portion into which a distal end of a tool used for screwing the set screw into the female thread portion is inserted and which communicates with the drain hole is formed on an end of the set screw located on the inner peripheral surface side of the blade root ring.

5. The stator blade segment according to claim 1, wherein lengths of the set screw and the male thread portion are shorter than a length of the female thread portion, the blade root ring has a plastic deformation portion in which a portion of the bottom surface of the drain recessed portion for partitioning the hole is plastically deformed in a direction toward a central axis of the hole, and the plastic deformation portion abuts on an end portion of the set screw disposed on an inside in a radial direction.

6. A steam turbine comprising:

the stator blade segment according to claim 1;

a rotor which has a rotating shaft which is disposed so as to penetrate a space formed in a center of the stator blade segment and rotates with the axis as a central axis, and a plurality of rotor blades which are provided on the rotating shaft at intervals from each other in a circumferential direction of the rotating shaft and extend radially outward; and a casing which has a tubular shape with the axis as a central axis and has the stator blade segment provided on an inner peripheral surface.

* * * * *